United States Patent [19]

Pasquin

[11] Patent Number: 4,712,520

[45] Date of Patent: Dec. 15, 1987

[54] CRANK CASE COMPRESSOR UNIT FOR A TWO CYCLE ENGINE

[76] Inventor: John Pasquin, 3254 S. Barney, West Valley City, Utah 84119

[21] Appl. No.: 889,347

[22] Filed: Jul. 25, 1986

[51] Int. Cl.[4] ..... F02B 33/04

[52] U.S. Cl. ..... 123/73 S; 137/855

[58] Field of Search ..... 123/73 AF, 65 BA, 73 A, 123/73 S; 137/48, 49, 481, 513, 843, 852, 855

[56] References Cited

U.S. PATENT DOCUMENTS

| | | | |
|---|---|---|---|
| 2,377,833 | 6/1945 | Warner | 123/73 S |
| 2,432,725 | 12/1947 | Connelly | 123/73 S |
| 2,434,348 | 1/1948 | Brown | 123/73 S |
| 2,529,864 | 11/1950 | Brevard | 123/73 S |
| 2,547,327 | 4/1951 | King | 123/73 S |

FOREIGN PATENT DOCUMENTS

| | | | |
|---|---|---|---|
| 2104147 | 3/1983 | United Kingdom | 123/65 BA |

*Primary Examiner*—Craig R. Feinberg
*Assistant Examiner*—David A. Okonsky
*Attorney, Agent, or Firm*—Trask, Britt & Rossa

[57] ABSTRACT

A means of continuously pressurizing an air/fuel mixture residing within a crankcase of a two cycle internal combustion engine is disclosed. The crankshaft fitted flywheel or counterweight of the engine is mounted with a plurality of vanes which extend from a central region of the flywheel outward to the periphery of the flywheel. The vanes are positioned over the entire surface of the flywheel. A ducting channel which receives a air/fuel mixture charge from the carburetor directs that charge to the central region of the flywheel. In operation the crankshaft rotates the flywheel causing the fuel charge to be uniformly hurled outward from the central region to the periphery of the flywheel. The forces acting on the charge serves to compress the mixture within the crankcase. At low engine revolutions as well as for starting the engine the conventionally accepted use of one way reed valve induction is used. The improvement of the instant invention engine includes the considerable increase of carburated air induction by use of an internal housed compressor. The invention also includes a means of mechanically opening the reed valves to allow full open induction when the compressor has reached sufficient angular velocity to keep the induction charge flowing in one direction.

7 Claims, 9 Drawing Figures

CRANK CASE COMPRESSOR UNIT FOR A TWO CYCLE ENGINE

BACKGROUND OF THE INVENTION

1. Field

This invention relates generally to internal combustion engines and is specifically directed to a two cycle, internal combustion engine. More particularly, this invention is directed towards a means for pressurizing the fuel charge's introduction into the combustion chamber of the engine. The compressing is done internally in the crankcase without adding, additional weight, parts, or power drive devices.

2. Prior Art

Two cycle engines are well known in the art. These engines find application in vehicles such as motorcycles, snowmobiles, or small motorized machinery such as lawnmowers. In general, these engines are used in applications wherein a small weight motor with a large power output is a requirement.

A typical engine construction includes a engine block defining a open-ended cylinder. This cylinder is fitted on its one end with an end cover mounted with a spark plug or a similar ignition type device. Fitted within the cylinder is a piston which is dimensioned and configured to be reciprocally displaced within the cylinder between two opposing positions; a first position wherein the head of the piston is positioned substantially contiguous the cover fitted end of the cylinder, and its attendant spark plug and a second position wherein the piston is positioned proximate the open end of the cylinder.

The piston is fitted with a pivotally mounted connecting rod which extends from the piston to a pivot mounting on a crankshaft. The crankshaft is rotatably mounted within the engine block. In a conventional construction the crankshaft includes an axis of rotation which is oriented substantially perpendicular to the axis of the reciprocating displacement of the piston.

The crankshaft, is mounted in part within a hollow cavity within the engine block generally denoted as a crankcase. The crankcase communicates with a carburetor which is adapted to receive air from the environment and combine that air with a combustible such as gasoline, thereby producing a combustible mixture. The combustible mixture is channeled from the carburetor, through the crankcase and then into a combustion chamber during the engine's operation. The combustion chamber is defined as that space bounded by the cylinder walls, the end cover and the top of the piston.

Since the cylinder is in open communication with the crankcase, a displacement of that piston effects the air pressure within that crankcase. As the piston descends from its uppermost position, i.e. its positioning proximate the cover fitted end, the downward displacement of the piston operates to compress or pressurize the combustible mixture which has been received within the crankcase via the carburetor. When the piston reaches a predetermined location within the cylinder, ports are opened or exposed within the walls of the cylinder. The ports communicate with the combustion chamber. Each of the ports are fed by a respective transfer channel defined within the structure of the engine block. The channels in turn communicate with the crankcase.

The fuel mixture which was pressurized within the crankcase by the downward descent of the piston is directed through the channels into the combustion chamber due to the differential in pressures between the crankcase and combustion chamber.

Upon the piston head reaching its lower-most position i.e., the position proximate the open-end of the cylinder, it begins its upward ascend within the cylinder. As the piston ascends, the air pressure within the crankcase is decreased. As the piston reaches a predetermined height within the cylinder, the ports which permit the entry of combustible mixture into the cylinder are closed. The combustible mixture within the combustion chamber is compressed by the continuing upward ascent of the piston. As the piston reaches a predetermined location in its upward ascent, an electrical charge is directed to the spark plug which in turn produces a spark within the combustion chamber. The spark ignites the fuel mixture and produces a explosive reaction. The explosion directs the piston forcefully downward within the cylinder. Thereafter the process is repeated pursuant to the sequence just described.

An exhaust port or ports are defined within the wall of the cylinder. These ports lead from the combustion chamber to an exhaust manifold. As the piston head descends under the force of the explosion, the exhaust ports, which were sealed by the piston in its uppermost positioning are exposed. Exhaust products produced within the combustion chamber are then evacuated from the chamber through the exhaust ports to the exhaust manifold.

In a conventional engine the displacement of the combustible mixture from within the crankcase upward into the combustion chamber in association with the upward ascent of the piston results in a vacuum or low pressure region within the crankcase itself. The differential in internal pressure between the carburetor and the crankcase facilitates an induction of a charge of combustible mixture from the carburetor into the crankcase.

A compression of the combustible mixture prior to the combustion of that mixture operates to increase the power released by that combustion. In the conventional approach the combustible mixture is somewhat pulsedly compressed within the crankcase by the descent of the piston within the cylinder. This compression in the crank case is enhanced by the compression which subsequently occurs within the upper regions of the combustion chamber as the piston ascends; i.e. that compression of the combustible mixture within the ever decreasing volume of the upper reaches of the cylinder.

The concept of super charging or turbo charging an engine is well known. Typically, turbocharging involves compressing or pressurizing the air portion of the combustible mixture prior to mixing that air with the fuel in the carburetor to form the combustible mixture. This compression is usually accomplished in a structurally separate chamber which is mounted to the exterior of the engine. After being pressurized the air is channeled to the carburetor for purposes of mixing it with fuel.

Other efforts have been directed toward pressurizing the combustible mixture itself i.e., after the mixing of the air and fuel.

U.S. Pat. No. 4,261,306 (Gorr) discloses a deflector plate mounted proximate the periphery of the flywheels housed within the crankcase. The deflectors serve to scoop the boundary layer of combustible mixture which is located adjacent the flywheel periphery and deflect it toward the transfer channels. By doing so Gorr claims that the charging of combustible mixture into the combustion chamber is increased due to the force occasioned by the rapidly moving combustible mixture in the crankcase.

In U.S. Pat. No. 4,362,132 (Newman), a flywheel of the crankshaft is configured to include a periphery annular recess or pocket about approximately 180° of its structure. The pocket is positioned in opposition to the eccentric point of connection of the connecting rod to the flywheel. The pocket cylinder communicates with the fuel inlet port and carburetor. The pocket operates to receive a fuel charge from the carburetor and tangentially throw that charge into the transfer ducts.

U.S. Pat. No. 2,410,471 (Warner) discloses a multicylinder radial engine having a crankshaft mounted fan including vanes mounted about half of its perimeter. The Warner fan operates to direct combustible mixture through a channel into a pressure chamber located beneath the reciprocating piston. As the piston descends the combustible mixture is compressed and directed into the combustion chamber of an adjacently positioned cylinder. The solid portion of the blower fan perimeter serves to close the channel. Resultingly, the fan serves as a valve for pulsedly feeding the pressure chamber beneath the piston.

SUMMARY OF THE INVENTION

The instant invention includes a means of pressurizing, in substantially a constant as opposed to a pulsed fashion, the combustible fluid mixture within the crankcase, prior to its introduction into the combustion chamber. More specifically the instant invention includes a means of pressurizing the combustible mixture by means of a vane mounted fly wheel mounted on the crankshaft. The fly wheel is adapted to rotate within the crankshaft thereby compressing the fuel mixture within the crankcase as the mixture enters the crankcase.

Structurally the invention includes the modified use of a conventional two stroke engine which includes a engine block defining an elongate cylinder therein. The cylinder has an open end and a cover fitted end positioned on the opposite end of that cylinder. On the cover fitted end of the cylinder is mounted a spark plug which is adapted to receive an electrical charge and thereby produce a spark for purposes of initiating combustion. The open end of the cylinder communicates directly with the crankcase of the engine block. A descent of the piston within the cylinder pressurizes the crankcase.

The crankcase is a substantially hollow chamber fitted below the cylinder. Fitted within the crankcase is a crankshaft which extends longitudinally within the crankcase.

A piston is mounted within the cylinder. The piston is adapted to reciprocate between the cover fitted end and the open end of the cylinder. Operationally, as the piston descends within the cylinder, a fluid, combustible mixture is pushed into the upper region of the cylinder, i.e., into that portion of the cylinder between the piston and the cover fitted end of the cylinder. This upper region will be denoted the combustion chamber. The mixture is compressed by the ascent of the piston. As the piston finally reaches its uppermost position, thereby achieving the maximum compression the fluid mixture, the spark plug is given an electrical charge producing a spark which initiates combustion of the fluid mixture. The piston thereafter descends within the cylinder until finally reaching a position proximate the open end of the cylinder.

The piston includes a connection rod which is pivotedly mounted at its proximal end to the piston. It is connected to the crankshaft such that the reciprocation of the piston operates to turn the crankshaft. The piston descends and ascends along a generally vertical axis, whereas the crankshaft is positioned substantially perpendicular to the axis of reciprocation. The crankshaft rotates about a longitudinal axis which is substantially perpendicular to the axis of reciprocation of the piston.

In a conventional construction, the crankshaft is fitted with counterweights which facilitates a transfer of power from the piston to the crankshaft. In the instant invention, one of these counterweights may be denoted as a flywheel. This flywheel may include, as a base member, a flat planar panel. In a preferred embodiment, this base member presents a generally circular circumference. The flywheel may be mounted on the crankshaft such that the axis of rotation of the crankshaft passes through the centroid or center of means of the flywheel. The flywheel is fitted on its face with a plurality of vanes. These vanes are mounted on the flywheel beginning at a point proximate the centroid, hereinafter "the central region" of the flywheel, and radiate therefrom outward toward the periphery or circumference of the fly wheel. The entire circumference of the flywheel is intersected at regular intervals by vanes radiating outwardly from the central regions of the flywheel. Substantially, the entire surface of the flywheel is covered with these vanes i.e., the vanes are positioned about the entire 360° degrees of the base member. When the flywheel is seen in plan view, the vanes appear to radiate from the centroid. These vanes are sufficiently closely spaced that the fuel mixture from the carburetor which is directed against the vanes proximate the central region of the flywheel is directed outwardly in a substantially uniform fashion over the face of the flywheel. Since these vanes extend substantially about the entire face of the flywheel. The combustible mixture is uniformly accelerated due to the rotation of the flywheel. The flywheel thereby serves to function as an impeller to pressurize the combustible mixture within the crankcase. The flywheel not only pressurizes the mixture, but further it agitates it sufficiently to achieve a good homogenization of the mixture.

In some embodiments, a flat planar panel, similar in configuration to the base member of the flywheel, is mounted on the flywheel essentially parallel to the base member. This planar panel is mounted over the vanes, such that the vanes are substantially sandwiched between the base member and their planar panels. This construction is known as a "squirrel cage" blower fan.

The flywheel is adapted to receive a fluid mixture introduced to the fly wheel from the exterior of the engine block and due to the rotation of the flywheel thereafter direct that fuel mixture or combustible mixture outwardly into the space surrounding the crankshaft, i.e., against the walls defining the crankcase. The fly wheel operates to pressurize the fuel mixture within the crankcase as the crankshaft is rotated. Furthermore, since the flywheel vanes extend essentially about the total periphery or circumference of the flywheel they operate to affect a continuous as opposed to a pulsed pumping or compressing action on the fuel mixture.

Proximate the vane-fitted face of the flywheel is mounted a hollow tube-like extension of the fly wheel.

The extension makes up the crankshaft main journal. The extension is adapted to receive a charge of fuel mixture from the engine's inlet duct and carburetor and direct that fuel mixture to the central region of the flywheel. Thereafter, due to the rotation of that flywheel the fuel mixture gains a full contact with the flywheel from its central region outwardly along the vanes to the periphery or circumference of the fly wheel. This construction thereby maximizes or optimizes the amount of kinetic energy which is transferred to the fuel mixture by the crankshaft rotated flywheel.

The inlet port of the engine block which introduces fuel mixture from a carburetor to the inlet duct or extension may be fitted with a-one-way type valve or assembly. This valve may be a modified reed valve adapted to control the flow of combustible mixture into the crankcase. The valves function by utilizing the differential in pressure on opposing sides of a spring tensioned plate. This instant valve assembly includes an improved construction of conventionally known reed valves. Specifically, the valves have been modified to optimize the functional aspects of the instant invention. The reed valves are fitted on a frame-like support platform. This platform is hinged to be rotated or displaced by a carburetor throttle mechanism. In this hinged construction, the inlet reed valves may be held substantially open, i.e., the reed plates no longer open or close due to the differentials in pressure on opposite sides of the spring tensioned resilient cover plates. Instead, the reeds within the inlet duct of the engine block are substantially held open thereby uncovering the reed ports and permitting a maximum flow of combustible mixture into the crankcase.

DETAILED DESCRIPTION OF THE PREFERRED EMBODIMENT

Figure 1:
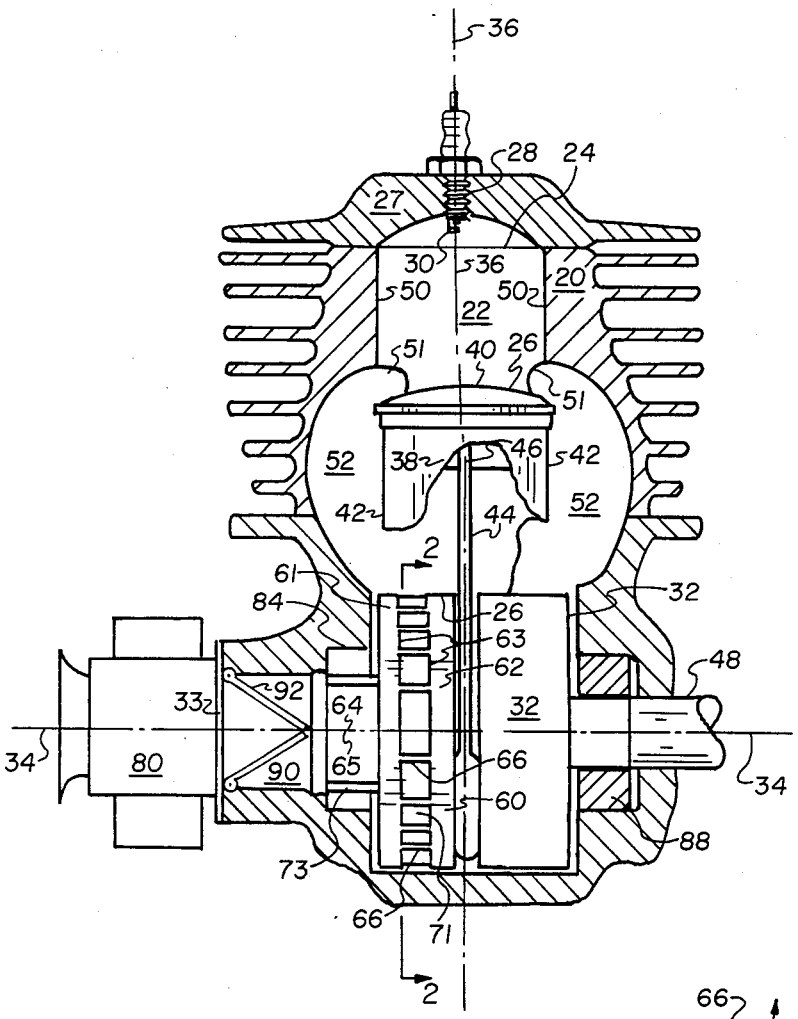
FIG. 1 is a side elevational cross-sectional view of a two-cycle engine of the instant invention.
Figure 2:
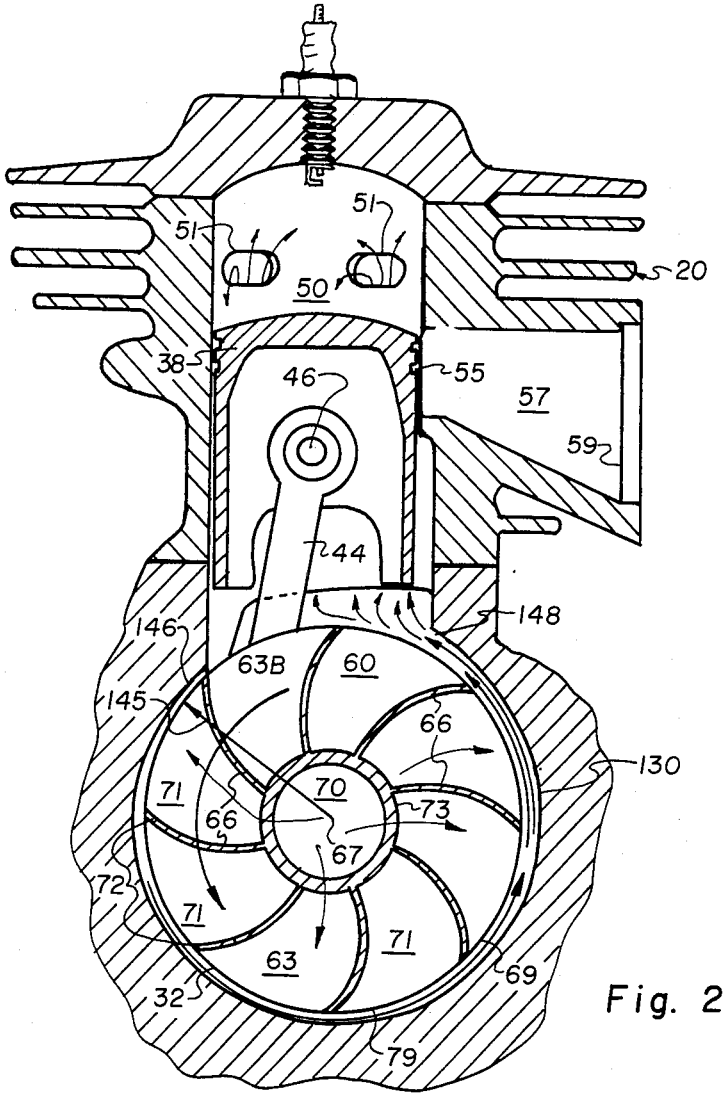
FIG. 2 is an elevational cross-sectional view of the engine shown in FIG. 1 shown from a perspective which is rotated ninety (90) degrees from the perspective of FIG. 1.

As shown in FIG. 1 and FIG. 2 a engine of the instant invention includes an engine block generally 20 having a hollow chamber 22 within the interior of the engine block 20. The chamber 22 may be cylindrical in configuration.

The chamber 22 will hereinafter be denoted as "cylinder". Notwithstanding this characterization, it is to be understood, that other chamber configurations are also within contemplation and intended to be within the scope of this disclosure.

The chamber 22 has a enclosed end 24 and a open end 26. The enclosed end 24 of the chamber 22 is fitted with a cover plate or cylinder head 27 which includes a spark plug 28 adapted to produce an electrical spark at its proximal end 30. The engine block 20 also defines a crankcase 32 which is positioned contiguous and communicates the open end 26 of cylinder 22 therewith. As is shown the crankcase 32 is generally cylindrical in configuration and includes a longitudinal axis 34 which longitudinal axis is generally oriented perpendicular to the longitudinal axis 36 of cylinder 22.

A cylindrical-like piston 38 is dimensioned to be slidably received within the cylinder 22 and adapted to reciprocate within that cylinder between the open end 26 and the closed end 24. This piston includes a piston head 40, a piston sidewall 42 and a connecting rod 44 which is pivotally mounted to the piston head at point 46. Connecting rod 44 is generally a shaft-like member which extends somewhat parallel to the longitudinal axis 36 of the cylinder 22 and is pivotally mounted to the crankshaft 48, fitted within crankcase 32.

The cylinder 22 includes two inlet ports 51 defined within the sidewalls 50 of that cylinder. These inlet ports 51 communicate with two associated transfer channels 52 defined with the engine block 20. Channels 52 communicate with the crankcase 32 whereby gases contained within the crankcase 32 may be directed upwardly through the channels 52 and outwardly through the ports 51 into the cylinder 22.

In a preferred embodiment, an engine in the instant invention may include at least one but preferably two or more of these inlet channels 52 positioned substantially opposite or diametrically opposite one another about the cylinder 22.

Also, fitted within the sidewalls 50 of cylinder 22 is an exhaust port generally 55. Exhaust port 55 communicates with a hollow channel 57 defined within the engine block which is directed outwardly to the surface of the engine block. Channel 57 eventually terminates in discharge port 59. Combustion products within the cylinder 22 may be discharged through the port 55 into attendant channel 57, that channel 57 thereafter directs these products to port 59 where they are discharged either into the environment or alternately through an exhaust manifold.

Mounted on the crankshaft 48 is a flywheel generally 60. As shown in FIG. 1 and 2, the flywheel 60 may be substantially cylindrical in configuration. The flywheel 60 may include a pair of cylindrical base members 61 and 62. Base members 61 and 62 may each include a pair of flat opposing planar panel faces 63. Further, base members each include an axis of rotation respectfully 64 and 65. In a preferred construction, the base member 61 and 62 are positioned substantially in tandem whereby the axis of rotation 64 and 65 are co-linear.

Figure 3:
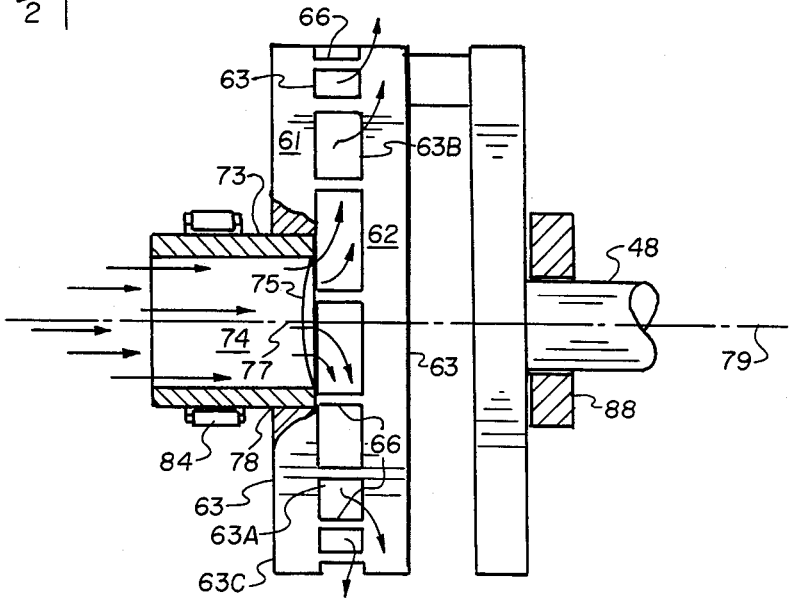
FIG. 3 is a side view of the flywheel and crankshaft of the instant invention. The Figure includes a cut-away view of the hollow extension mounted on the flywheel. As shown the flywheel may include a plurality of vanes sandwiched between two planar base members.

Fitted on the two of the opposing faces 63A and 63B of base members 61 and 62 are a plurality of vanes 66. As shown in FIG. 3, the vanes 66 may be substantially sandwiched between the base members 61 and 62. The vanes are curved members which are mounted to extend upright or substantially perpendicular away from the flat planar surface of panel faces 63A and 63B of base members 61 and 62. Each pair of adjacent vanes 66 defines a channel 71 there between. Vanes 66 are mounted to radiate from the center or centroid 67 of the respective base members 61 and 62 outwardly to the circumference or periphery 69 of the panels 63A and 63B. As shown in FIG. 2 the vanes 66 are positioned over the entire face of opposing panels 63. The vanes 66 intersect the circumferences 69 of the panels 63 at intervals or arcs over the entire length of that circumference 69. In a preferred embodiment, the lengths of the various arcs 72 defining those intervals is constant i.e. the vanes 66 intersect the circumference 69 at regular and constant arc-length intervals 72 over the entire length of circumference 69. The vanes 66 are adapted to receive a quantity of fluid proximate the central region 70 proximate the centroid 67 and direct that fluid through the channels 71 defined between each pair of adjacent vanes 66 outward to the circumference 69 of the panels 63. In a preferred construction the flywheel 60 is mounted on crankshaft 48 such that the axis of rotation 64 and 65 of base members 61 and 62 are co-linear with the longitudinal axis 34 of crankshaft 48.

Mounted on base member 61 is an extension 73. As shown in FIG. 3, base member 61 may define an inlet 75 therein which is preferably located proximate the centroid 77 of that base member. Inlet 75 communicates end panel 63A with end panel 63C of that base member. Extension 73 is a hollow tubular member, which may be cylindrical in configuration. As shown in FIGS. 2 and 3 this extension 73 is fitted with a hollow interior channel 74 which is configured to receive a flow of combustible mixture from an externally mounted carburetor 80. Extension 73 is inserted into inlet 75 such that channel 74 communicates with vanes 66. In a preferred construction, extension 73 is mounted into base member 61 such that the interior channel 74 communicates with the central region 70 of base member 62. Extension 73 may be press-fit mounted into inlet 75. Extension 73 is adapted to direct that flow against the central regions of the flywheel 60 as shown in FIG. 3.

Figure 4:
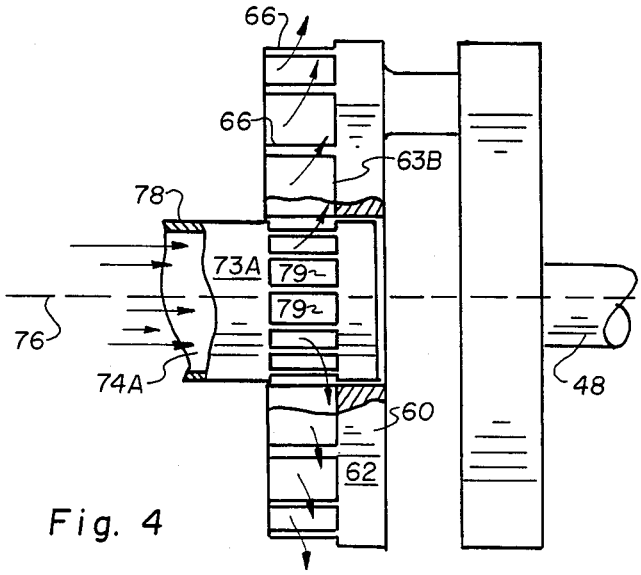
FIG. 4 is side view of an alternate embodiment of the flywheel of this invention fitted to a crankshaft. A cut-away in the Figure shows a hollow extension mounted on the flywheel. As shown the flywheel may include a single planar base member fitted with a plurality of vanes.

An alternate embodiment of this invention utilizes a flywheel 60 in which base member 61 is removed, i.e. the flywheel includes a single base member 62 having vanes 66 affixed thereto. A flywheel of this construction is shown in FIG. 4. In plan view this alternate flywheel appears substantially similar to the sectional view of the flywheel shown in FIG. 2.

The extension 73 which is utilized in the alternate embodiment of the flywheel is modified in order to accommodate the changed configuration of that flywheel. This modified extension 73A, shown in FIG. 4 is generally tubular and defines an interior channel 74A similar to that of extension 73. This extension 73A, in a preferred embodiment, is cylindrical in configuration and includes a longitudinal axis 76. The extension 73 is mounted on base member 62 such that the longitudinal axis 77 is substantially perpendicular to the planar surface 63B of base member 62. The sidewalls 78 of extension 73A which define interior channel 74A are perforated with a plurality of apertures 79. The apertures 79 extend about extension 73A in a belt-like or circumferential band. The apertures 79 are positioned to communicate with central region 70 of base member 62.

The extension 73A is configured to receive a supply of fuel mixture into its interior channel 74A from the carburetor 80. The mixture flows through the channel 74A and then exits the channel 74A through apertures 79. Upon exiting through apertures 79, the mixture flows into the central region of base member 62 proximate vanes 66. The rotating vanes 66 distribute the mixture outwardly toward the circumference of base member 62.

The extensions 73 and 74A are mounted within the crankcase by means of bearings 84. Preferably these bearings are needle-bearings. The crankshaft 48 does not extend through the total crankcase 32. Functionally, the extension 73 or 73A may be viewed as an extension of the crankshaft 48. When the complete crankshaft/flywheel assembly is installed within crankcase 32, the crankshaft axis 34 is colinear with the longitudinal axis 79 of extension 73 or the longitudinal axis 76 of extension 73A. Both extensions 73 and 73A are supported by bearings 84 similar to the bearings 88 which support crankshaft 48. The bearings 84 and 88 permit the crankshaft and extensions to rotate about axis 34. The bearings 84 and 88 serve to stabilize the crankshaft/flywheel assembly as it rotates.

The extension 73 is positioned proximate an inlet channel 90 which is defined by the structure of the engine block 20. The region of inlet channel 90 proximate the outer edge of the block is shaped to receive a pyramid shaped reed assembly 92. In appearance the reed valve assembly 92 approximates a conventional reed valve assembly. This valve assembly may include a pyramid configured support structure 111 having a first planar wall 100 defining therein an aperture generally 112. Two panels 116 are mounted on the wall 100 to extend therefrom in an angulated fashion. Two upright walls 118 are mounted upright on wall 100 and are joined with panels 116 to form a hollow box-like structure 120. Aperture 112 communicates with the hollow interior 122 of structure 120. Each of the panels 116 define at least one if not more ports 124 which also communicate with the interior 122. Fitted over each port 124 is a cover plate 126 which is dimensioned and configured to seal the port 124. Each plate 126 is fabricated from spring-loaded steel or some other resilient material. One end of each cover plate is affixed to a panel 116. Each plate 126 is biased into a sealing relationship with its respective port 124.

According to the instant invention each of the cover plates 126 positioned on respective wall 116 is affixed to a hinge generally designated 120. Hinge 120 includes an elonated panel 121 fitted with a tubular housing dimensioned to slidably receive a pivot rod 122. Pivot rod 122 includes a longitudinal axis 123. The pivot rod 122 is fixedly mounted on wall 116. Hinge panel 121 is made rotatable about axis 123. As hinge panel 121 rotates each of the respective cover plates 126 either cooperatively seal or open their respective ports 124.

The hinges may be mounted by means of a connective linkage 128 to a throttle control. At a preselected engine speed the hinge is rotated by that linkage about the axis 123 thereby opening each of the apertures for a direct flow route through the inlet port 112 and the various ports 124.

Figure 8:
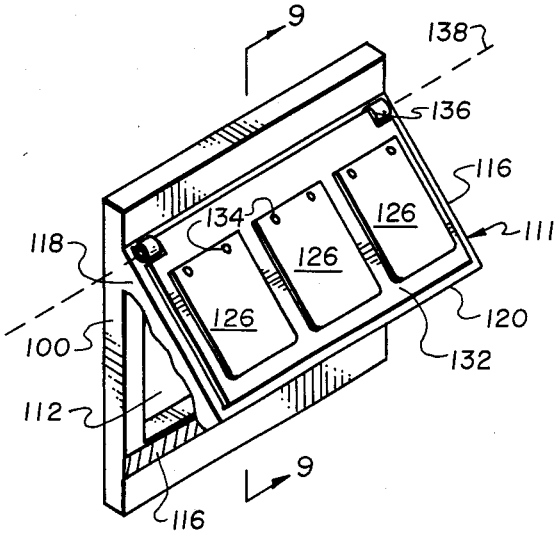
FIG. 8 is an elevated perspective view of an alternate embodiment of the improved reed valve adapted for use in the engine of the instant invention. The view includes a cut-away portion revealing the valve's inlet port.
Figure 9:
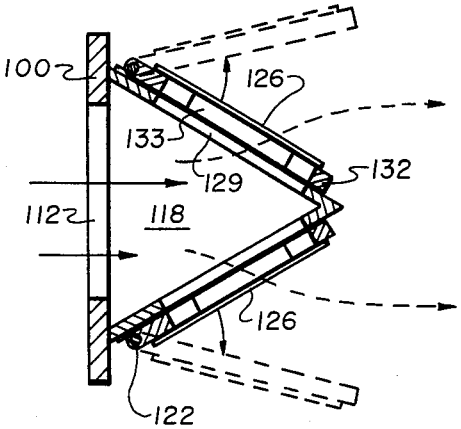
FIG. 9 is a cross sectional view of the reed valve shown in FIG. 8 taken along section lines 9—9.

A second embodiment of the reed valve assembly is shown in FIG. 8 and 9 wherein the walls 116 each includes only one large port 129 as opposed to a plurality of individual ports 124. In the assembly of FIG. 8 a planar platform generally designated 132 defines a plurality of ports 133. Each port 133 is fitted with a respective individual cover plate 126. Each of the cover plates 126 are pivotally fixed to the platform 132 by pins or rivets 134 and adapted to seal its respective port 133. The plates 126 are permitted to open and close subject to pressure differentials between the crank case and the carburetor.

Figure 6:
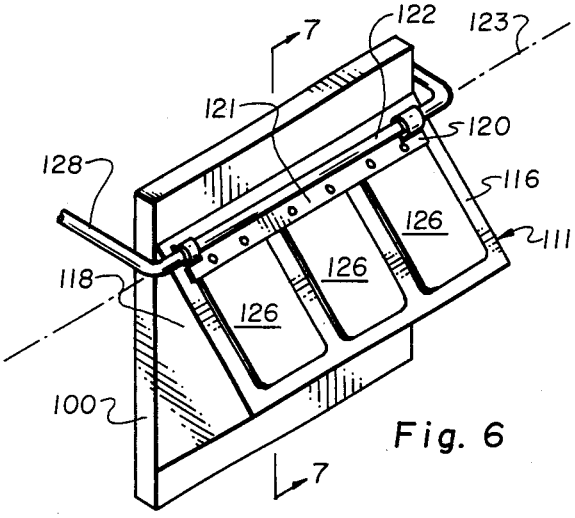
FIG. 6 is a elevated perspective view of an improved reed valve adapted for placement into the inlet port of an engine of the instant invention.
Figure 7:
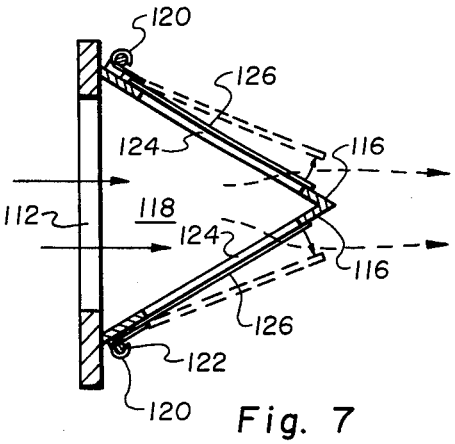
FIG. 7 is a cross-sectional side view of the reed valve shown in FIG. 6 taken along section line along section lines 7—7.

The platform 132 is pivotally fixed to the wall 116 through means of hinges 136. The support platform 132 is constructed to rotate about the pivot axis 138 and thereby remove the support platform 132 from its sealing relationship against wall 116. When the platform is pivoted a clear passageway through inlet channel 112 and port 129 into the channel 90 is exposed. The platform 132 may be connected to a throttle linkage in a manner similar to that described above for the valve assembly shown in FIG. 6 and 7.

During the instant engine's operation at low revolutions (RPM's) the combustible mixture is induced into the crankcase from the carburetor principally because of the pressure differential created by the displacement of the piston in the cylinder. As the combustible mixture in the crankcase is channeled into the combustion chamber and the piston begins its upstroke, the pressure within the crankcase is low compared to that within the carburetor. As a result, the reed valves flex open to permit an equalization of pressure, i.e. combustible mixture flows into the crankcase as conventionally occurs in an unmodified two cycle engine. The valves close when the piston begins its downstroke, as pressure within the crankcase is increased. As the engine speed increases, the vaned flywheel or compressor induces a steady flow of combustible mixture from the carburetor through the reed valve assembly. Resultingly the reed valves are rendered unnecessary. Upon the engine reaching this level, the cover plates may be pivoted, by the linkage, to positions which are out of contact with the respective ports thereby defining a clear flow channel through the valve. When the engine speed is decreased below the predetermined level the cover plates are rotated back to their former positions over their respective ports. In this condition, the plates function as described for low engine RPM's.

Figure 5:
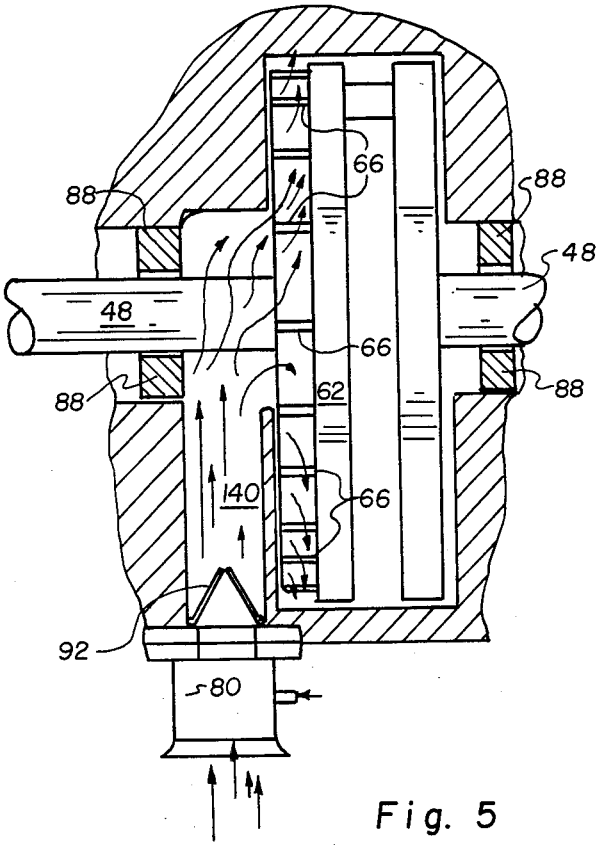
FIG. 5 is a cross-sectional top view of a flywheel of this invention having a mounted carburetor at 90° to the crankshaft axis. The carburetor communicates with an attendant inlet port adapted for receiving fuel mixture from the carburetor and directing that mixture into the central region of the flywheel.

FIG. 5 illustrates an alternate placement of the carburetor 80. In this embodiment the carburetor is positioned on the side of the engine block 20, whereby the inlet channel 140 is positioned substantially perpendicular to the longitudinal axis 34 of the crankshaft. In this embodiment no tube extension 73 is utilized, instead the conventional crankshaft configuration is retained. The elimination of extension tube 73 permits the installation of ball type bearings 88 as well as the extension of the crankshaft 48 through the entirety of the crankcase as opposed to the limited crankshaft length shown in the FIGS. 1 and 2. In this alternate embodiment the combustible mixture is directed through channel 140 and then makes a ninety (90) degree angle turn into the central regions of the flywheel 60. The mixture is then directed outwardly by the vanes 66 of that flywheel 60 and into the crankcase itself.

The main benefit of the instant invention is the creation of compressed combustible mixture in the crankcase independent of the supplementary compressing action of the descending piston. Furthermore, this compression is continuous as opposed to the prior art devices which rely on a more pulsed compression as created by the conventional pulsed compression of the piston. Further, the instant flywheel effectuates an homogenization of the air fuel mixture received from the carburetor. This homogenization assists is achieving a better combustion of that mixture in the cylinder.

As shown in FIGS. 1 and 2, the crankcase of this invention is substantially cylindrical in configuration. The crankcase is defined by a sidewall 130 and a pair of end walls 144.

As shown in FIG. 2, a "radial distance" 145 may be defined as the distance separating the longitudinal axis 34 of crankshaft 48 and the sidewall 130. The distance is measured perpendicularly from the axis 34. In a preferred embodiment the length of the radial distance varies over the inner circumference of the sidewall 130. More specifically, the radial distance to a point generally 146, is dimensionally smaller than a radial distance measured to a point generally 148 which is located proximate channel 52. As shown in FIG. 2, the sidewall 130 may be configured such that the length of the radial distance increases continuously as that distance is measured counterclockwise between point 146 and point 148. This configuration contributes to providing a quantity of compressed fuel mixture proximate the inlet channel 52 that leads into the upper portion of the piston when the piston is in its most downward position.

Those skilled in the art will recognize that the embodiments here and before discussed are illustrative of the general principles of the invention. The embodiments herein described are not intended to limit the scope of the claims which themselves recite but applicant regards as his invention.

I claim:

1. In a two-cycle gasoline engine comprising a engine body, a cylinder in the body having a closed end and an open end, an enclosed crankcase in the body communicating with said open end, a crankshaft extending through the crankcase and rotatably mounted therein, a piston reciprocatively mounted in the cylinder, a connecting rod connecting the piston and the crankshaft, a carburetor positioned exterior of said engine body, an intake duct in said engine body communicating with the cylinder through which a combustible mixture enters said cylinder when said piston is adjacent said open end, an inlet port in said body communicating said carburetor with said crankcase, the improvement comprising:

a compressor means mounted within said crankcase adapted for continuously pressurizing a combustible mixture within said crankcase as said mixture is received from said carburetor, while said engine is in operation, said compressor means including:

a fly wheel, having a periphery and an axis of rotation, said flywheel being mounted on said crankshaft and made rotatable therewith, said flywheel having a plurality of vanes mounted thereon, said vanes extending from a central regioin of said flywheel outwardly to said periphery of said flywheel;

wherein said inlet port is positioned proximate said axis of rotation of said flywheel, said combustible mixture being directed initially to a central region of said flywheel and thereafter directed by said vanes outwardly to said periphery of said flywheel;

a reed-type valve mounted in said inlet port for allowing a one-way directional flow of combustible mixture, said reed type valve including:

a support frame adapted for sealing said inlet port, said support frame defining at least one aperture therein:

at least one cover plate fabricated of a resilient material pivotedly mounted on said support frame over said aperture, said cover plate being dimensioned to cover and seal said aperture;

each said cover plate being mounted on a hinge; said hinge being pivotedly mounted on said support frame; an angular displacement of said hinge about its axis of rotation facilitating a coordinated sealing and unsealing of said support frame aperture by a selected displacement of said cover plate;

wherein said combustible mixture being directed through said inlet port into said vaned flywheel, is constantly compressed within said crankcase due to the rotation of said flywheel within said crankcase.

2. The improvement according to claim 1 wherein said hinge is made mechanically cooperative with a carburetor throttle valve associated with said engine, said valve being mechanically cooperated with said hinge to operably open and retain said cover plates in an unsealed orientation in correspondence with a speed of said engine.

3. In a two-cycle gasoline engine comprising an engine body, a cylinder in the body having a cover fitted end and an open end, an enclosed crankcase in the body communicating with said open end, a crankshaft extending through the crankcase and rotatably mounted therein, a piston reciprocatively mounted in the cylinder, a connecting rod connecting the piston to the crankshaft, an intake duct in the body communicating with the cylinder and through which a combustible mixture enters said cylinder when said piston is adjacent said open end, and exhaust duct in the body communicating with the cylinder, an inlet port in said body communicating said carburetor with said crankcase, the improvement comprising:

a flywheel mounted on an end of said crankshaft and made rotatable therewith, said flywheel having a first flat planar base member with a plurality of vanes mounted thereon which extend outwardly from a central region of said first base member, said central region being proximate a common axis of rotation of said flywheel and said crankshaft, said vanes extending outward to a periphery of said flywheel and positioned about the entire surface of said base member;

said flywheel including a second flat planar base member mounted on said vanes, said second base member being positioned substantially parallel to said first base member wherein said vanes are positioned between said first a second base members;

an induction extension mounted on said flywheel, said extension being elongate and tubular in configuration, and defining an interior channel; said extension having a first longitudinal axis which longitudinal axis is substantially parallel to said axis of rotation of said flywheel; said extension being adapted to receive a quantity of combustible mixture from said inlet port and direct said mixture through said interior channel to said central region of said flywheel;

a reed-type valve is mounted in said inlet port to allow a one-way directioned flow through said inlet port; said reed type valve comprising:

a support frame mounted within said inlet port to seal said inlet port, said support frame defining at least one aperture;

at least one cover plate, fabricated of a resilient material, pivotedly mounted on said support frame over said aperture; said cover plate being dimensioned to cover and seal said aperture; wherein said cover plate is unsealed by a pressure differential between pressure within said crankcase and pressure within said carburetor;

wherein said cover plates are each mounted on a hinge; displacement of said hinge facilitating a coordinated sealing and unsealing of said support frame apertures by a displacement of said cover plates;

wherein said combustible mixture upon being received in said central region of said flywheel is directed outwardly by said vanes;

wherein a rotation of said flywheel continuously compresses said combustible mixture within said crankcase.

4. The improvement according to claim 3 wherein said hinge is made mechanically cooperative with a carburetor throttle valve associated with said engine wherein said cover plates may be held in an unsealed positioning with respect to said apertures by said valve operating on said hinge, said unsealed positioning facilitating a continuous, uninterrupted supply of combustible mixture to said flywheel.

5. In a two-cycle gasoline engine comprising an engine body, a cylinder in the body having a cover fitted end and an open end, an enclosed crankcase in the body communicating with said open end, a crankshaft extending through the crankcase and rotatably mounted therein, a piston reciprocatively mounted in the cylinder, a connecting rod connecting the piston to the crankcaew, an intake duct in the body communicating with the cylinder and through which a combustible mixture enters said cylinder when said piston is adjacent said open end, an exhaust duct in the body communiating with the cylinder, an inlet port in said body communicating said carburetor with said crankcase, the improvement comprising:

a flywheel mounted on said crankshaft and made rotatable therewith, said flywheel having a first flat planar base member with a plurality of vanes mounted thereon which extend radially from a central region of said first base member, said central region being proximate a common axis of rotation of said flywheel and said crankshaft, said vanes extending outwardly to a periphery of said flywheel;

wherein said inlet port is adapted to receive quantity of combustible mixture from said carburetor and direct said mixture to said central region of said flywheel;

a valve means for allowing an one-way passage of said combustible mixture through said inlet port, said valve means being positionable in an open condition, said vave means being further positionable in a closed condition at low engine speeds, said valve means being directly acted upon by a pressure differential between pressure within said crankcase and pressure within said carburetor;

wherein said valve means is retainable in an open condition, independently of said pressure differential, at high engine speeds, by connection to a throttle valve associated with said engine;

wherein said combustible mixture upon received in said central region of said flywheel is directed outwardly by said vanes;

wherein a rotation of said flywheel continuously compresses said combustible mixture within said crankcase.

6. A reed valve for use in an inlet port for a two-cycle engine for allowing a one way directioned flow of combustible mixture, said reed valve comprising:

a support frame adapted for sealing said inlet port, said support frame defining at least one aperture therein;

at least on cover plate, fabricated of resilient material, pivotedly mounted by a hinge on said support frame over said aperture, said cover plate being dimensioned to cover and seal said aperture;

a linkage connected to said hinge and a carburetor throttle valve whereby said hinge is made mechanically cooperative with said carburetor throttle valve and at engine revolutions above a predetermined level, said cover plates may be held in an unsealed position by said linkage and throttle valve.

7. In a two-cycle gasoline engine comprising an engine body, a cylinder in the body having a cover fitted end and an open end, an enclosed crankcase in the body communicating with said open end, a crankshaft extending through the crankcase and rotatably mounted therein, a piston reciprocatively mounted in the cylinder, a connecting rod connecting the piston to the crankshaft, an intake duct in the body communicating with the cylinder and through which a combustible mixture enters said cylinder when said piston is adjacent said open end, an exhaust duct in the body communicating with the cylinder, an inlet port in said body communicating said carburetor with said crankcase, the improvement comprising:

a flywheel mounted on said crankshaft and made rotatable therewith, said flywheel having a first flat planar base member with a plurality of vanes mounted thereon which extend radially from a central region of said first base member, said central region being proximate a common axis of rotation of said flywheel and said crankshaft, said vanes extending outwardly to a periphery of said fly wheel;

wherein said inlet port is adapted to receive a quantity of combustible mixture from said carburetor and direct said mixture to said central region of said flywheel;

a valve means for allowing an one-way passage of said combustible mixture through said inlet port, said valve means being positionable in an open condition, said valve means being further positionable in a closed condition at low engine speeds, said valve means condition being directly acted upon by a pressure differential between pressure within said crankcase and pressure within said carburetor;

a valve control means for controlling said valve means at high engine speed, said valve control means being adapted to retain said valve means in an open condition, independently of said pressure differential, at high engine speeds, wherein said valve means provides a continuous uninterrupted supply of combustible mixture to said flywheel;

wherein said combustible mixture upon being received in said central region of said flywheel is directed outwardly by said vanes;

wherein a rotation of said flywheel continuously compresses said combustible mixture within said crankcase.

* * * * *